US006918802B2

(12) United States Patent
Watabe et al.

(10) Patent No.: US 6,918,802 B2
(45) Date of Patent: Jul. 19, 2005

(54) STARTING SYSTEM FOR OUTBOARD MOTOR

(75) Inventors: Hiroshi Watabe, Wako (JP); Hideaki Takada, Wako (JP); Yoshinori Masubuchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 105 days.

(21) Appl. No.: 10/670,383

(22) Filed: Sep. 26, 2003

(65) Prior Publication Data

US 2004/0072481 A1 Apr. 15, 2004

(30) Foreign Application Priority Data

Oct. 2, 2002 (JP) ..... 2002-289972

(51) Int. Cl.[7] ..... B63H 21/21; B63H 20/00

(52) U.S. Cl. ..... 440/85; 440/1; 123/179.1; 123/198 DC; 307/10.6; 307/10.7

(58) Field of Search ..... 440/1, 2, 84–87; 123/179.1, 179.3, 198 D, 198 DC; 307/9.1, 10.1–10.8

(56) References Cited

U.S. PATENT DOCUMENTS 3,652,868 A * 3/1972 Hunt ..... 307/116
3,951,091 A * 4/1976 Doench ..... 114/211
4,213,513 A * 7/1980 Beck ..... 180/272
4,917,061 A * 4/1990 Nagakura ..... 123/179.3
5,144,300 A * 9/1992 Kanno ..... 340/984
5,637,022 A * 6/1997 Koike et al. ..... 440/87
5,670,831 A * 9/1997 Georgiades ..... 307/10.3
5,886,419 A * 3/1999 Saito et al. ..... 307/10.1
5,936,316 A * 8/1999 Jurkiewicz et al. ..... 307/10.6
5,988,130 A * 11/1999 Nakamura ..... 123/179.5
6,077,133 A * 6/2000 Kojima et al. ..... 440/1
6,582,261 B2 * 6/2003 Kanno ..... 440/84

FOREIGN PATENT DOCUMENTS

JP 2001-173545 6/2001

OTHER PUBLICATIONS

A part of a manual for Honda outboard motor BF115A/BF130A, p. 2–20, p. 17–29, edited by Honda Kogyo Kabushikigaisha's Department of Maintenance Materials and published on May, 1998 (See p. 1 in the spec).

* cited by examiner

*Primary Examiner*—S. Joseph Morano
*Assistant Examiner*—Ajay Vasudeva
(74) *Attorney, Agent, or Firm*—Westerman, Hattori, Daniels & Adrien, LLP

(57) ABSTRACT

In an engine starting system for an outboard motor mounted having a propeller and a steering mechanism driven by an electric motor, including a battery connected to the engine; a starter motor and an ignition switch provided in a voltage supply circuit from the battery to the starter motor, the positions of the ignition switch is arranged to have a START position at which the starter motor, the electric motor and other electric loads are supplied with the voltage from the battery; an ON position at which the voltage supply to the starter motor is discontinued when the key is turned from the START position, a first OFF position at which the voltage supply to the electric motor and the other electric loads is discontinued when the key is turned from the ON position, and a second OFF position at which the current supply to the electric actuator is still continued when the key is turned from the ON position. With this, the system can allow the operator to operate the steering mechanism even when the engine is stopped, while effectively preventing the battery from becoming dead.

12 Claims, 8 Drawing Sheets

FIG. 7

| | E | I.G | BATT | STE | LOAD | ST |
|---|---|---|---|---|---|---|
| OFF 1 | ○ | ○ | | | | |
| OFF 2 | ○ | ○ | ○ | ○ | | |
| ON | | | ○ | ○ | ○ | |
| ST | | | ○ | ○ | ○ | ○ |

STARTING SYSTEM FOR OUTBOARD MOTOR

BACKGROUND OF THE INVENTION

1. Field of the Invention

This invention relates to a starting system for an outboard motor.

2. Description of the Related Art

A starting system for an outboard motor internal combustion engine comprises a battery, a starter (starter motor) and ignition (ignition/starter) switch. Among of them, a typical ignition switch has "OFF-ON-START" positions. When the operator inserts an ignition key into the keyhole of the ignition switch and turns it to the "START" position beyond the "ON" position, the battery voltage is supplied to the starter motor (and to the fuel pump and the ignition system, etc.) and other various electric loads including an electronic control unit (ECU), instruments, lamps, etc. to start the engine. After the engine has started, when the operator turns or returns the key to the "ON" position, the battery voltage to the starter motor is discontinued, but it is still supplied to the other electric lords, and the engine continues to run. When the operator turns or returns the key to the "OFF" position, the battery voltage supply to the other electric loads is discontinued and the engine is stopped, as taught, for example, by a manual for Honda outboard motor BF115A/BF130A, 2–20, page 17–29, edited by a department of maintenance materials and published on May, 1998 by Honda Giken Kogyo Kabushiki Kaisha.

Further, in on-road vehicles, their ignition switches are extended to have an additional "ACCESSORY" position. In particular, in a vehicle that stops engine during vehicle stop or a hybrid vehicle (constituted as a hybrid of an internal combustion engine and an electric motor(s)) has a relay, in the circuit between the battery and the ignition/starter switch, operable independently of the operator's key manipulation in such a way that the engine can be stopped and re-started at the "ON" position, as taught in Japanese Laid-Open Patent Application No. 2001-173545.

Aside from the above, in recent outboard motors, mechanisms for steering, shift-changing and throttle are electronically controlled using actuators such as electric motors. It will be convenient for the operator if he or she can operate these mechanisms, especially, the mechanisms for steering and shift-changing even when the engine is stopped, since the boat itself keeps moving after the engine was stopped.

In order to allow the operator to operate the mechanisms when the engine is stopped, i.e., when the key is at the "OFF" position, it will be possible to supply the battery voltage to the electric actuators for the mechanisms all the time at this position. However, if doing so, since idling current leaks to the actuators even if the mechanisms are out of operation, it becomes necessary to add a switch in the circuit in such a way that the operator breaks the connection between the actuators and the battery when the mechanisms are out of operation, or to pull out a cable (extending from the battery terminal to the actuators). This is tedious for the operator and if he or she misses, the battery will be discharged and is finally dead.

Other alternative will be to supply the battery voltage to the actuators when the key is at the "ON" position. Since this can easily stop the battery voltage supply to the actuators to avoid idling current flow by turning the key to the "OFF" position, it can prevent the battery from becoming dead.

However, as mentioned above, since the battery voltage is still supplied to various electric loads such as instruments and lamps at the "ON" position, the battery is likely to be dead if the key is kept at the "ON" position for a long period of time when the engine is stopped.

Moreover, the outboard motor engine is equipped with an emergency switch that disconnects the battery from the ignition system in case of emergency, without needing the key to be turned to the "OFF" position. If the engine is stopped by this emergency switch, since the ignition switch remains at the "ON" position, the battery is also likely to be dead if this "ON" position is kept for a long period of time.

SUMMARY OF THE INVENTION

An object of the present invention is therefore to overcome the foregoing problems by providing a starting system for an outboard motor that allows the operator to operate a mechanism driven by an electric actuator that is operable when supplied with power from a battery even when the engine is stopped, while effectively preventing the battery from becoming dead.

In order to achieve the foregoing object, this invention provides a system for starting an internal combustion engine installed in an outboard motor mounted on a boat and having a propeller powered by the engine and a mechanism driven by an electric actuator, the engine having other electric loads including at least an electronic control unit to be used for operating the engine, including: a battery connected to the engine; a starter motor that starts the engine when voltage is supplied from the battery; and an ignition switch provided in a voltage supply circuit from the battery to the starter motor, the electric actuator and the electric loads; the ignition switch having positions selected by an ignition key; wherein the positions of the ignition switch including at least a START position at which the starter motor, the electric actuator and the electric loads are supplied with the voltage from the battery; an ON position at which the voltage supply to the starter motor is discontinued when the key is turned from the START position, a first OFF position at which the voltage supply to the electric actuator and the electric loads is discontinued when the key is turned from the ON position, and a second OFF position at which the current supply to the electric actuator is still continued when the key is turned from the ON position.

BRIEF DESCRIPTION OF THE DRAWINGS

The above and other objects and advantages of the invention will be more apparent from the following description and drawings, in which:

FIG. 7 is a table showing the operation of a switching section of the ignition switch that makes or breaks the connection in the power (voltage) supply circuit in response to the position of the ignition switch selected by the operator.

DETAILED DESCRIPTION OF THE PREFERRED EMBODIMENT

A starting system for an outboard motor according to an embodiment of the present invention will now be explained with reference to the attached drawings.

Figure 1:
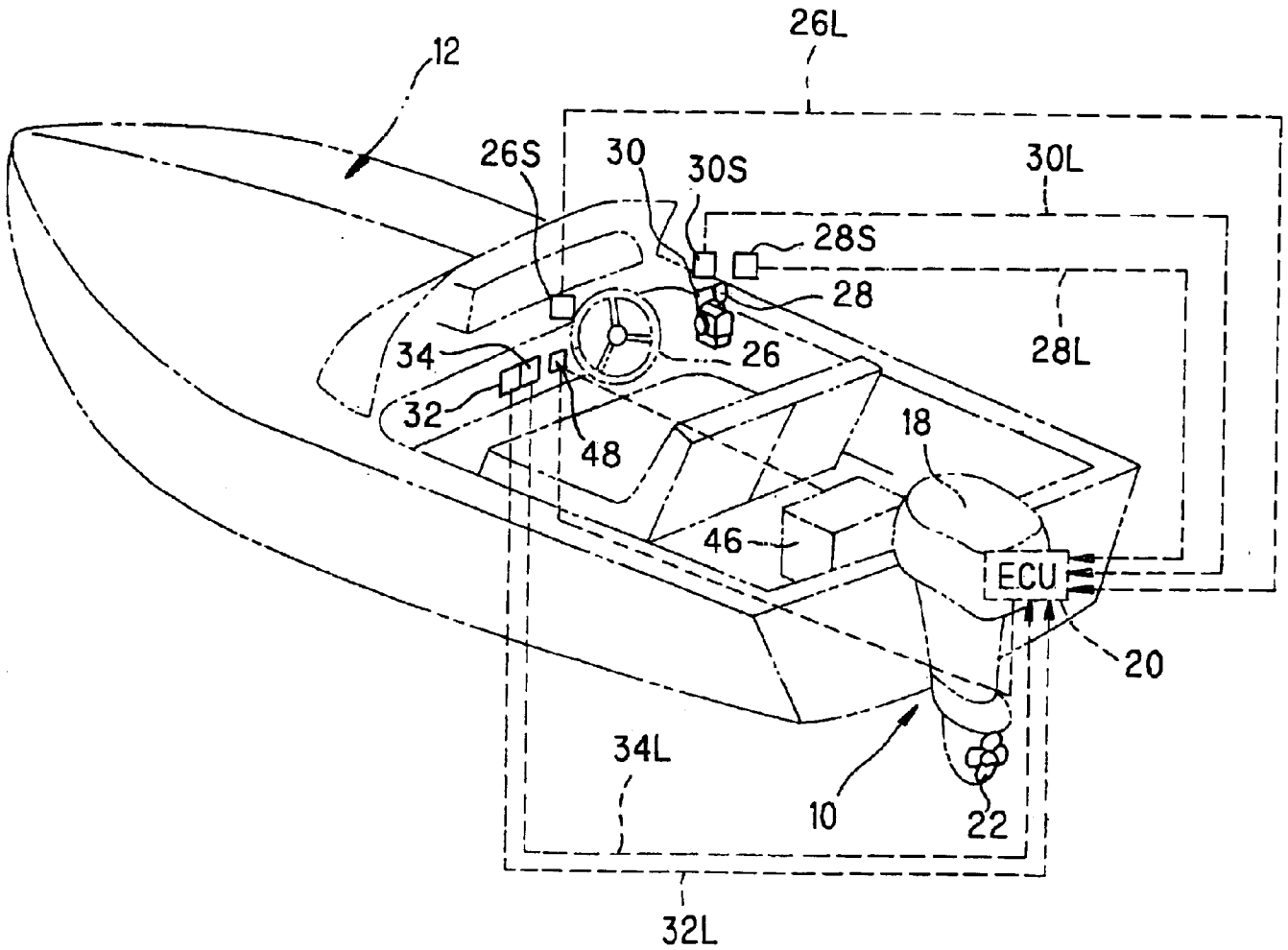
FIG. 1 is an overall schematic view of a starting system for an outboard motor according to an embodiment of the invention.
Figure 2:
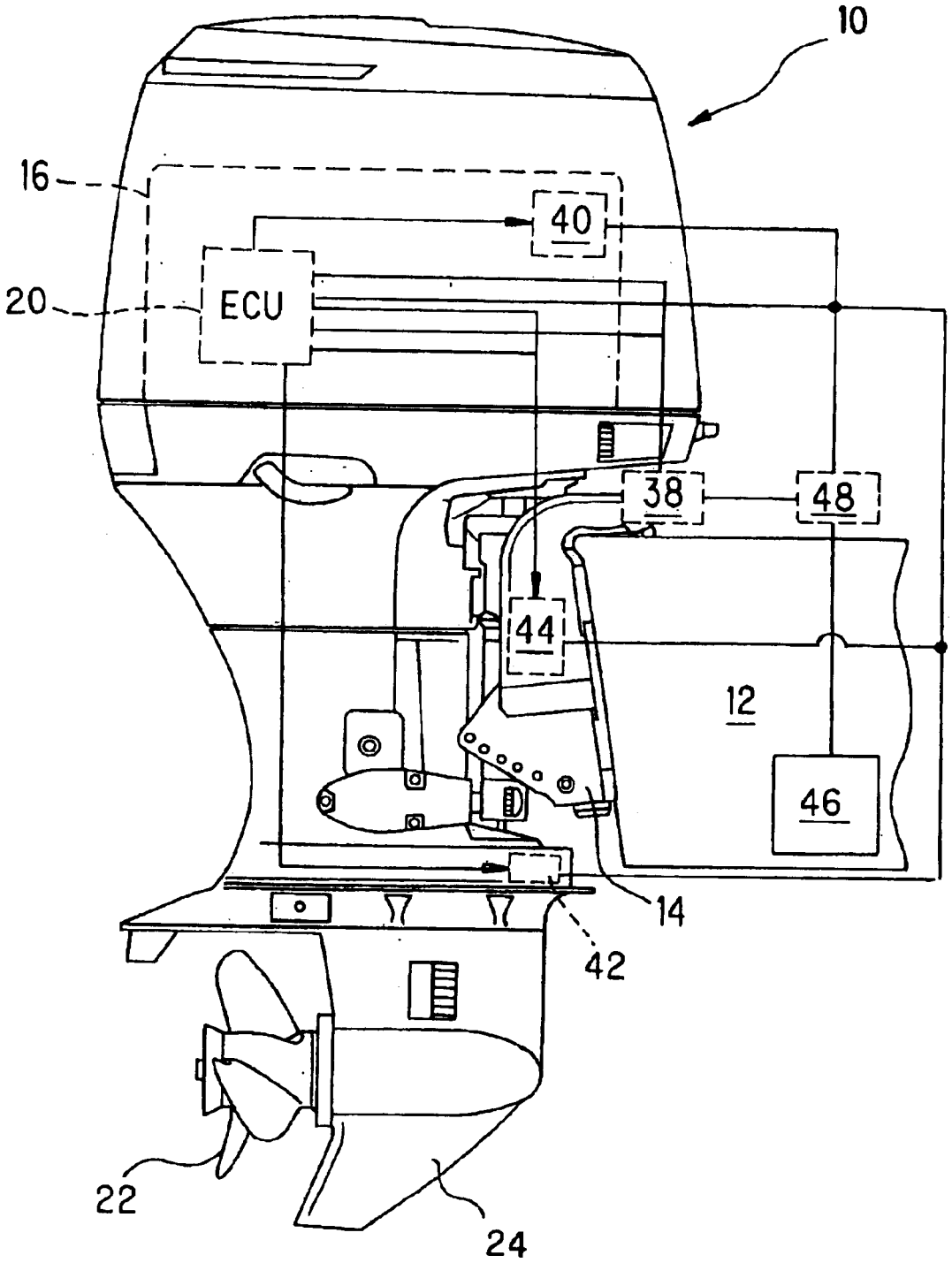
FIG. 2 is an explanatory side view of a part of FIG. 1.

FIG. 1 is an overall schematic view of the system with main focus on an outboard motor, and FIG. 2 is an explanatory side view of a part of FIG. 1.

Reference numeral 10 in FIGS. 1 and 2 designates an outboard motor built integrally of an internal combustion engine, propeller shaft, propeller and other components. The outboard motor 10 is mounted on the stern of a hull (boat) 12 via stern brackets 14 (shown in FIG. 2).

As shown in FIG. 2, an internal combustion engine 16 is installed at the upper portion (in the gravitational direction indicated) of the outboard motor 10. The engine 16 is a spark-ignition, V-type six-cylinder gasoline engine with a displacement of 2,200 cc. The engine 16, located inside the outboard motor 10, is enclosed by an engine cover 18 and positioned above the water surface. An electronic control unit (ECU) 20 constituted of a microcomputer is installed near the engine 16 enclosed by the engine cover 18.

The outboard motor 10 is equipped at its lower part with a propeller 22 and a rudder 24. The rudder 24 is fixed near the propeller 22 and does not rotate independently. The propeller 22, which operates to propel the boat 12 in the forward and reverse directions, is powered by the engine 16 through a crankshaft, drive shaft, gear mechanism and shift mechanism (none of which is shown), as will be explained later.

As shown in FIG. 1, a steering wheel 26 is installed near the operator's seat of the boat 12, and a steering angle sensor 26S installed near the steering wheel 26 outputs a signal in response to the turning of the steering wheel 26 by the operator. A throttle lever 28 is mounted on the right side of the operator's seat, and a throttle lever position sensor 28S installed near the throttle lever 28 outputs a signal in response to the position of the throttle lever 28 by the operator.

A shift lever 30 is mounted on the right side of the operator's seat near the throttle lever 28, and a shift lever position sensor 30S is installed near the shift lever 30 and outputs a signal in response to the position of the shift lever 30 by the operator. A power tilt switch 32 for regulating the tilt angle and a power trim switch 34 for regulating the trim angle of the outboard motor 10 are also installed near the operator's seat. These switches output signals in response to tilt up/down and trim up/down instructions input by the operator. The outputs of the steering angle sensor 26S, the throttle lever position sensor 28S, the shift lever position sensor 30S, the power tilt switch 32 and power trim switch 34 are sent to the ECU 20 over signal lines 26L, 28L, 30L, 32L and 34L.

In response to the output of the steering angle sensor 26S sent over the signal line 26L, the ECU 20 operates an electric motor 38 (for steering; shown in FIG. 2) to steer the outboard motor 10, i.e., change the direction of the propeller 22 and rudder 24, and thereby turn the boat 12 right or left. And, in response to the output of the throttle lever position sensor 28S sent over the signal line 28L, the ECU 20 operates an electric motor (for throttle) 40 (not shown in FIGS. 1 and 2) to move the throttle valve and regulate the amount of air to be sucked into the engine 16.

Further, in response to the output of the shift lever position sensor 30S sent over the signal line 30L, the ECU 20 operates an electric motor (for shift-changing) 42 to change the rotational direction of the propeller 22 or cut off the transmission of engine power to the propeller 22. Moreover, in response to the outputs of the power tilt switch 32 and power trim switch 34 sent over the signal lines 32L, 34L, the ECU 20 operates a conventional power tilt-trim unit 44 to regulate the tilt angle and trim angle of the outboard motor 10.

A battery 46 is installed at an appropriate location of the hull (boat) 12. The voltage (power) of the battery 46 is supplied, via an ignition/starter switch (or combination switch; herein simply referred to "ignition switch") 48 provided at or near the operator' seat, to the electric motor (for steering) 38, the electric motor (for throttle) 40, the electric motor (for shift-changing) 42, the power tilt-trim unit 44 and the ECU, etc. As shown in FIG. 2, the battery voltage supply line (circuit) to the electric motor (for steering) 38 is made separate from that to the other electric loads.

Figure 3:
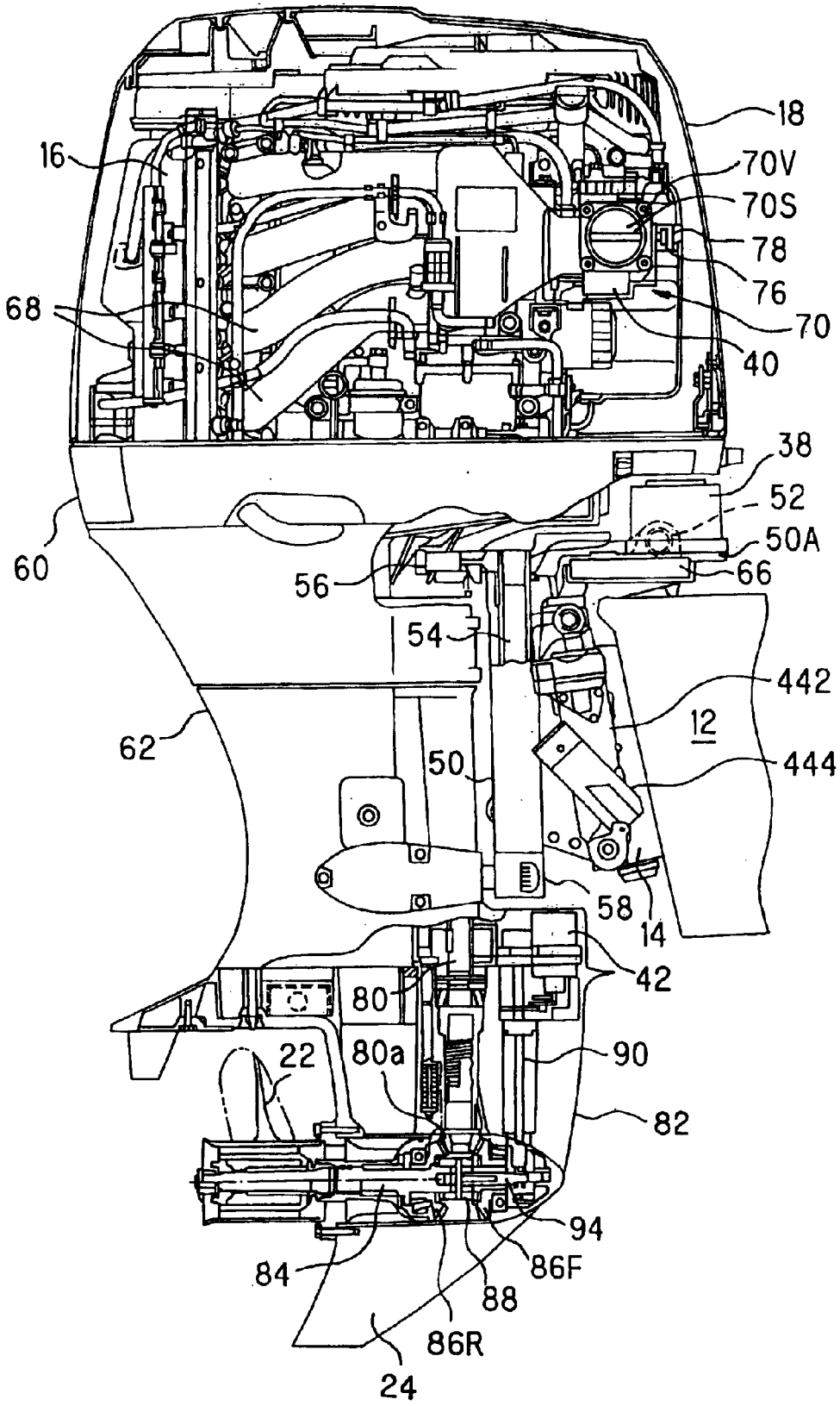
FIG. 3 is an enlarged explanatory side view of FIG. 2.

FIG. 3 is an enlarged explanatory side view. While this is basically an enlargement of FIG. 2, it should be noted that it is portrayed in a partially cutaway manner with the right side of the stem bracket 14 removed (the right side looking forward (toward the boat or hull 12)).

As illustrated in FIG. 3, the power tilt-trim unit (tilt-trim angle regulation mechanism) 44 is equipped with one hydraulic cylinder 442 for tilt angle regulation (hereinafter called the "tilt hydraulic cylinder") and, constituted integrally therewith, two hydraulic cylinders 444 for trim angle regulation (hereinafter called the "trim hydraulic cylinders"; only one shown).

As shown in FIG. 3, one end of the tilt hydraulic cylinder 442 is fastened to the stern bracket 14 and through it to the boat 12 and the other end (piston rod) thereof is fastened to a swivel case 50. One end of each trim hydraulic cylinder 444 is fastened to the stem bracket 14 and through it to the boat 12, similarly to the one end of the tilt hydraulic cylinder 442, and the other end (piston rod) thereof abuts on the swivel case 50.

The swivel case 50 is connected to the stem bracket 14 through a tilting shaft 52 to be relatively displaceable about the tilting shaft 52. A swivel shaft 54 is rotatably accommodated inside the swivel case 50. The swivel shaft 54 has its upper end fastened to a mount frame 56 and its lower end fastened to a lower mount center housing 58. The mount frame 56 and lower mount center housing 58 are fastened to an under cover 60 and an extension case 62 (more exactly, to mounts covered by these members).

The electric motor 38 (for steering) and a gearbox (gear mechanism; steering mechanism) 66 for reducing the output of the electric motor 38 are fastened to an upper portion 50A of the swivel case 50. The gearbox 66 is connected to the output shaft of the electric motor 38 at its input side and is connected to the mount frame 56 at its output side. To be more specific, horizontal steering of the outboard motor 10 is thus power-assisted using the rotational output of the electric motor 38 to swivel the mount frame 56 and thus turn the propeller 22 and rudder 24.

As shown in the figure, the engine 16 is installed at the upper portion of the under cover 60 and the engine cover 18 is fastened thereon to cover the engine 16. The engine 16 has a throttle body 70 that is placed at a front position (at a position close to the hull or boat 12) inside the engine cover 18. Sucked air flows through the throttle body 70 and an intake manifold 68, and is drawn into cylinders (not shown).

The throttle body 70 is integrally connected with the electric motor (for throttle) 40 in such a way that the motor 40 is connected to a throttle shaft 70S (that supports a throttle valve 70V) via a gear mechanism (throttle mechanism; not shown) provided close to the throttle body 70.

The output of the engine 16 is transmitted to a propeller shaft 84 (housed in a gear case 82) through the crankshaft (not shown) and a driveshaft 80, to rotate the propeller 22. The aforesaid rudder 24 is integrally formed on the gear case 82. A forward gear 86F and a reverse gear 86R are provided around the propeller shaft 84 and mesh with a drive gear 80*a* to be rotated in opposite directions. A clutch 88 is provided between the forward gear 86F and the reverse gear 86R to be rotated with the propeller shaft 84. By engaging the clutch 88 with the forward gear 86F or the reverse gear 86R through the operation of a shift rod 90 and a shift slider 94 that are driven or moved by the electric motor (for shift-changing) 42, the direction of propeller rotation is changed and the shift-changing is effected between the forward advancing and reverse advancing. Thus, the shift-changing mechanism comprises the drive gear 80*a*, the forward gear 86F, the reverse gear 86R, the clutch 88, the shift rod 90 and the shift slider 94.

The engine 16 will now be explained with reference to FIG. 4.

Figure 4:
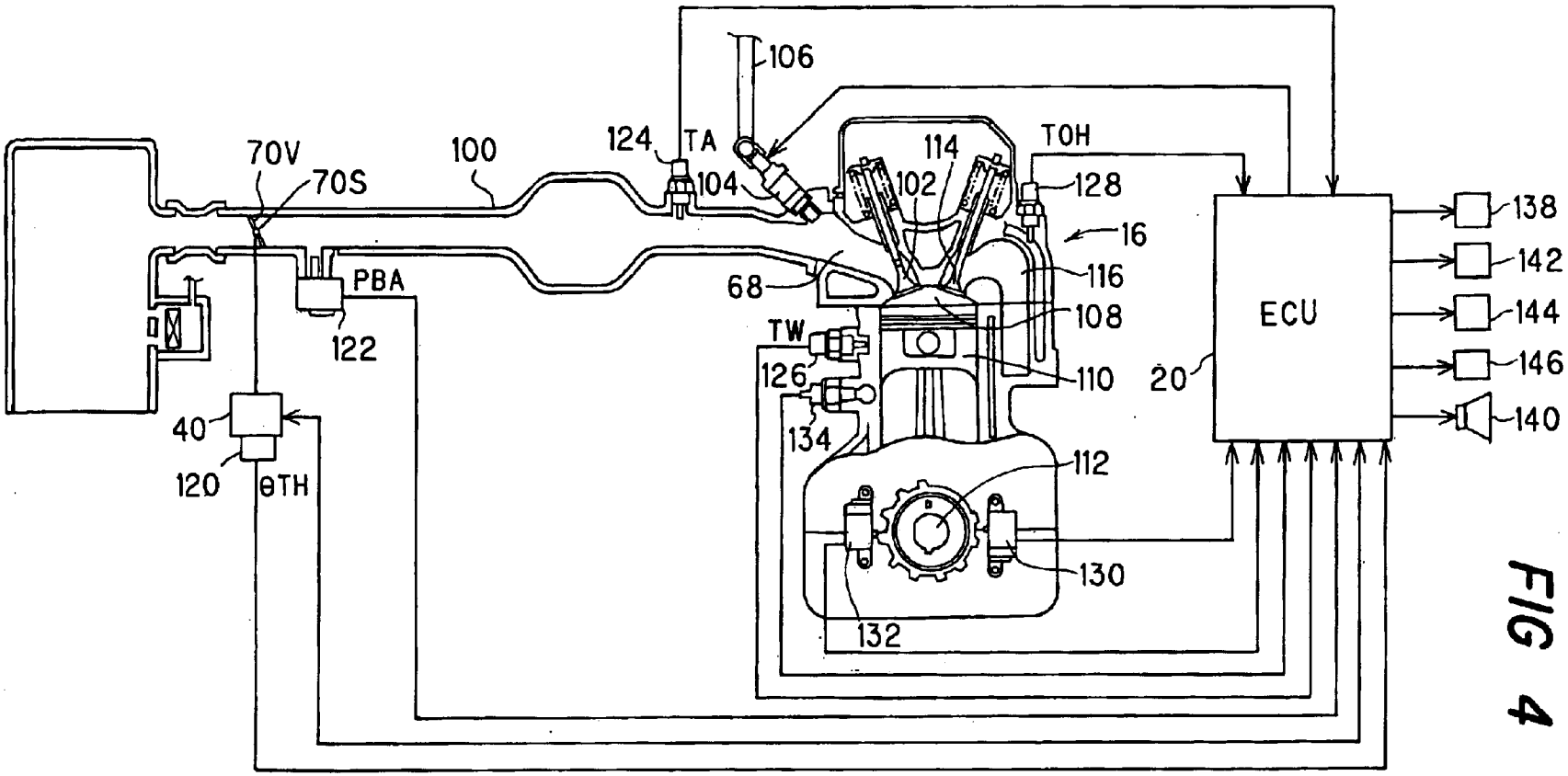
FIG. 4 is an overall schematic view of the engine installed in the outboard motor illustrated in FIG. 1.

As shown in FIG. 4, the engine 16 is equipped with an air intake pipe 100. Air drawn in through an air cleaner (not shown) is supplied to the intake manifolds 68 provided one for each of left and right cylinder banks (not shown), while the flow thereof is adjusted by the throttle valve 70V, and finally reaches an intake valves 102 of the respective cylinders (only one shown). A fuel injector 104 is installed in the vicinity of each intake valve 102 for injecting fuel (gasoline).

The fuel injector 104 is connected through a fuel pipe 106 to a fuel tank (not shown) containing gasoline. The fuel pipe 106 passes through a fuel pump (not shown) that pressurizes gasoline to be supplied to the fuel injector 104. The intake air is mixed with the injected gasoline to form an air-fuel mixture that flows into a combustion chamber 108 of each cylinder, where it is ignited by a spark plug (not shown) to burn explosively and drive down a piston 110. The so-produced engine output is taken out through a crankshaft 112. The exhaust gas produced by the combustion passes out through exhaust valves 114 into exhaust manifolds 70 (only one shown) provided one for each cylinder bank and is discharged to the exterior of the engine 16.

A throttle position sensor 120 is connected to the electric motor 40 and generates a signal proportional to the rotation of the motor 40 and indicative of the throttle opening θTH. A manifold absolute pressure sensor 122 is installed downstream of the throttle valve 70V and generates a signal indicative of the manifold absolute pressure PBA in the air intake pipe 100. In addition, an intake air temperature sensor 124 is installed downstream of the throttle valve 70V and generates a signal indicative of the intake air temperature TA.

A first temperature sensor 126 is installed in the water jacket (not shown) and generates a signal indicative of the engine coolant temperature TW, whilst a second temperature sensor 128 is installed in the vicinity of the exhaust manifolds 116 and generates a signal indicative of the engine temperature TOH.

A first pulser coil sensor 130 and a second pulser coil sensor 132 are installed in the vicinity of the crankshaft 112 and generates a cylinder discrimination signal, an angle signal indicative of the top dead center (TDC) of each piston and a crank angle signal once every 30 degrees.

An oil pressure (hydraulic) switch 134 is installed in the engine hydraulic circuit (not shown) and generates an OFF-signal when the oil pressure is greater than a predetermined value (i.e., when the amount of engine oil is sufficient), whilst it generates an ON-signal when the oil pressure is less than the predetermined value (when the amount of engine is insufficient)

These signals (outputs) of the sensors and switch are sent to the ECU 20. The ECU 20 detects or calculates the engine speed NE from the output of the first and second pulser coil sensors 130, 132. And it calculates a current command value from the output of the throttle lever position sensor 28S and outputs to the electric motor 40 through a driver (not shown) to drive the motor such that the throttle opening θTH is regulated as desired.

Moreover, the ECU 20 determines if the engine 16 overheats from the output of the second temperature sensor 128 and when the engine 16 is detected to be overheated, it turns on a warning lamp 138 and sounds a buzzer 140 to alert the operator. Further, the ECU 20 determines if the oil pressure is low (the amount of oil is insufficient) from the output of the oil pressure switch 134 and when the oil pressure is detected to be low, it turns on a warning lamp 142 and sounds the buzzer 140. Moreover, the ECU 20 determines if a failure has occurred in the ECU itself or an alternator (not shown) and if it does, it turns on warning lamps 144 or 146 and sounds the buzzer 140. The ECU 20, the fuel injector 104, the sensors, the warning lamps 138, 142, 144, 146, the buzzer 140 and instruments (not shown) are supplied with the voltage from the battery 146 via the ignition switch 48 (omitted in FIG. 4).

The starting system according to the embodiment comprises the battery 146, the ignition switch 48 and a starter (starter motor; not shown).

Figure 5:
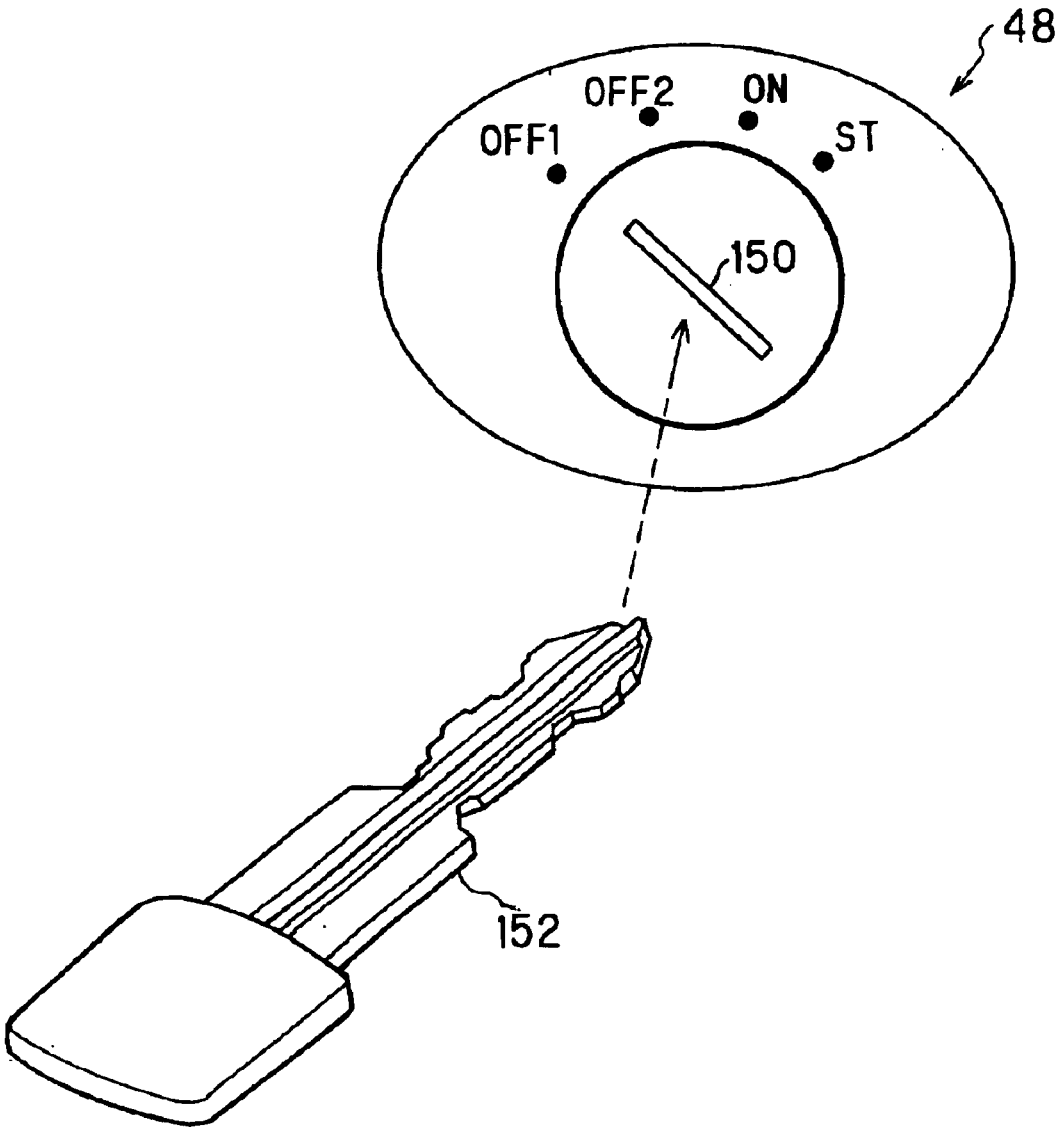
FIG. 5 is an enlarged explanatory perspective view of an ignition switch illustrated in FIG. 1.

The ignition switch 48 according to the embodiment will be explained with reference to FIG. 5. The figure is a schematic view showing the ignition switch 48.

As illustrated, the ignition switch 48 according to the embodiment has a "ST" position (indicative of "START" position) position, an "ON" position, an "OFF1" position (indicative of a first "OFF" position) and an "OFF2" position (indicative of a second "OFF" position). When the operator inserts an ignition key 152 into a keyhole 150 of the ignition switch 48 and turns it to one of the four positions, the one position is selected.

The positions of the ignition switch 48 will be explained with reference to FIG. 6. The figure is an electric diagram of the power (battery voltage) supply circuit including the ignition switch 48.

As illustrated, the ignition switch 48 has a switching section 160. The switching section 160 is connected with six current paths (wires) and in response to the ignition switch position selected by the operator, the section 160 makes or breaks the connections in the power supply circuit.

Explaining the six current paths, a first current path 162 (labeled as "E") is grounded. A second current path 164 (labeled as "IG") is connected to the ECU 20 and an emergency switch 166 is inserted between the ECU 20 and the switching section 160. A third current path (labeled as "ST") 168 is connected to a starter motor (starter) 170 that starts (cranks) the engine 16. A fourth current path (labeled as "STE") 174 is connected to a steering relay 176 and a fifth current path (labeled as "LOAD") 178 is connected to a main relay 180 that is in turn connected to a transistor 182.

A warning unit 184 is inserted between the switching section 160 and the main relay 180 that warns the operator not to leave the key 152 behind. The warning unit 184 is connected to the ECU 20, the buzzer 140 and the base terminal of the transistor 182. The warning unit 184 outputs an ON signal to the base terminal such that the transistor 182 is kept ON.

A sixth current path (labeled as "BATT") 186 is connected to the battery 46 and is connected to the electric motor (for steering) 38 through the steering relay 176. The sixth current path 186 is further connected to the ECU 20 and the other electric loads including the sensors, the lamps, the fuel pump and the spark plugs, etc., and to the electric motor (for throttle) 40, the electric motor (for gear-shifting) 42 and the power tilt-trim unit 44, through the main relay 180.

FIG. 7 is a table showing the operation of the switching section 160 that makes or breaks the connection in the power supply circuit in response to the position of the ignition switch 48 selected by the operator.

As shown, when the ignition switch is at the start (ST) position, the third to sixth current paths (ST, STE, LOAD, BATT) 168, 174, 176, 188 make the connection. Specifically, when the key 152 is turned to the START position, the battery voltage (current) is supplied from the battery 46 to the starter motor 170 to start or crank the engine 16, via the sixth current path 186 and the third current path 168.

At the same time, since the steering relay 176 is supplied with current from the battery 46 through the sixth current path 186 and the fourth current path 174, contact points 186*a*, 186*b* of the relay 176 at the sixth current path are switched on such that the battery voltage (current) is supplied to the electric motor (for steering) 38 to make it possible for the operator to steer the boat 12.

In addition, since current flows from the battery 46 to the main relay 180 through the sixth current path 186 and the fifth current path 178, contact points 186*c*, 186*d* of the relay 180 at the sixth current path 186 is made on and the battery voltage (current) is supplied to the electric loads, the motors 40, 42 and the unit 44. With this, the throttle valve 70V is made operable and the operator can operate the power tilt-trim unit 44 and the shift-changing mechanism, if desired.

Upon completion of starting of the engine 16, when the key 152 is turned to the ON position, the connection to the third current path 168 is broken and hence, the voltage supply to the starter motor 170 is discontinued. However, the voltage supply to the electric loads, the motors 38, 40, 42 and unit 44 is still continued.

Then, when the key 152 is turned or returned to the first OFF position (OFF1), the connection to the sixth current path 186 is broken and the voltage supply to the electric loads, the motors 40, 42 and the unit 44 is discontinued, and the ECU 20 is grounded through the second current path 164 and the first current path 162 and is terminated. With this, fuel supply and ignition to the engine 16 is ceased to stop the engine 16, and steering is made impossible any longer.

The characteristic feature of the ignition switch 48 according to the embodiment is that the second OFF position (OFF2) is added to the first OFF position (OFF1). When the key 152 is stopped at this second OFF position, the ECU 20 is grounded through the second current path 164 and the first current path 162, whilst the connection to the sixth current path 186 and the fourth current path 174 is made such that the battery voltage is supplied to the electric motor (for steering) 38 to make steering possible. With this, the operator can still steer the boat 12 even when the engine 16 is stopped. And, no idling current flows since the connection from the battery 46 to the other electric loads is broken, the battery 46 can be prevented from becoming dead.

Another characteristic feature of the switch 48 is that the key 152 can be inserted into or pulled out from the keyhole 150 only when the first OFF position (OFF1) is selected. With this, since the electric motor (for steering) 38 is disconnected from the battery 46 at this position, idling current does not leak and the battery 46 does not discharge.

Moreover, the ignition switch 48 is mechanically arranged such that, when returning from the second OFF position (OFF2) to the first OFF position (OFF1), the key 152 has to be kept pushed while turning (or a push button may instead be provided such that it has to be kept pushed while key turning). To be more specific, the switch 48 is mechanically arranged such that the manipulation of the key 152 to select the first OFF position is made different intentionally from that to select the second OFF positions. With this, the operator is prevented from mistaking the second OFF position for the first OFF position, thereby effectively enabling to prevent the battery 46 becoming dead.

Figure 6:
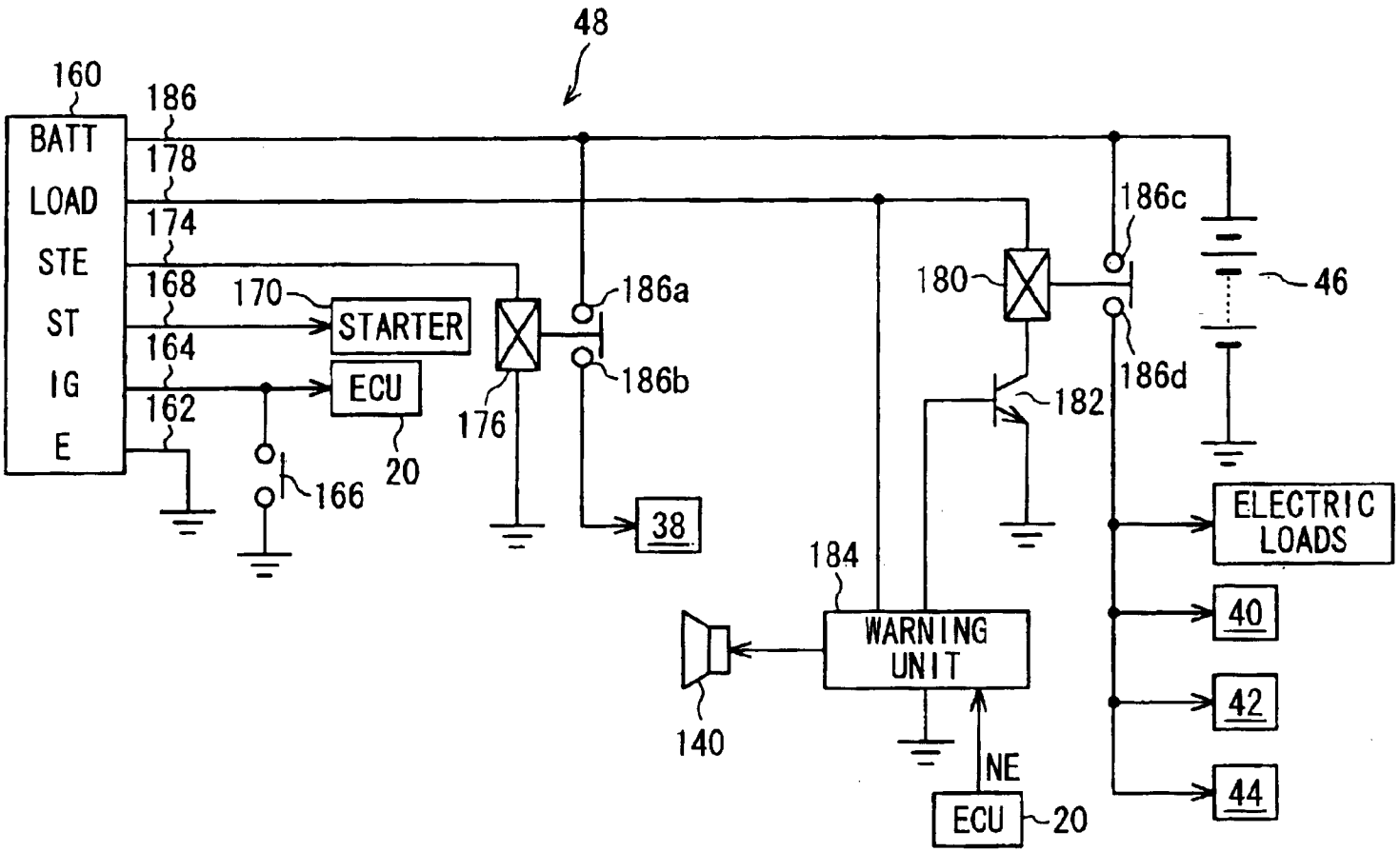
FIG. 6 is an electric diagram of a power (voltage) supply circuit including the ignition switch illustrated in FIG. 5.

As illustrated in FIG. 6, the warning unit 184 (for warning the operator not to leave the key 152 behind) is connected to the ECU 20 and is inputted with the detected engine speed NE. In addition, the warning unit 184 is connected to the buzzer 140 and to the base terminal of the transistor 182.

Figure 8:
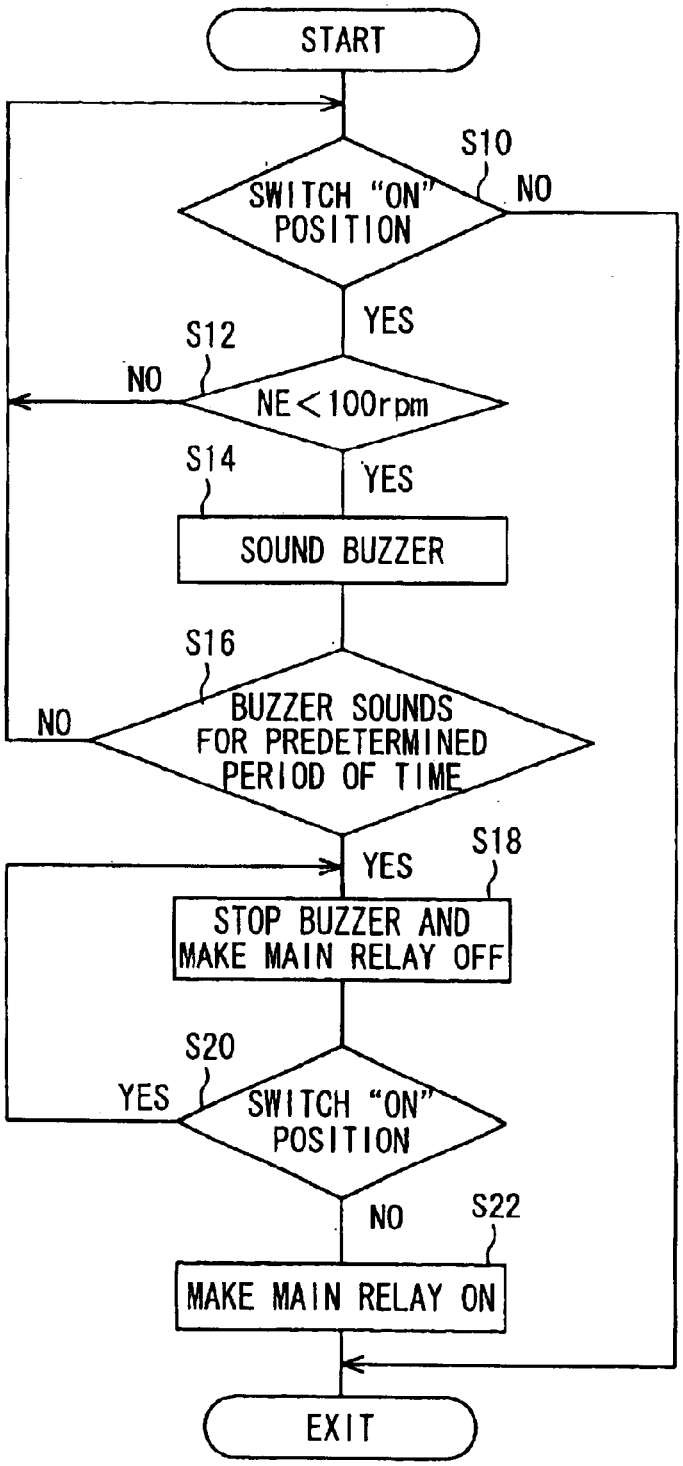
FIG. 8 is a flow chart showing the operation of a warning unit of the ignition switch for warning the operator not to leave an ignition key behind.

FIG. 8 is a flow chart showing the operation of the warning unit 184. The program illustrated there is executed when the START position or the ON position is selected in the ignition switch 48, in other words, it is executed when the battery voltage is kept supplied to the warning unit 184.

The program begins in S10 in which it is determined when the ON position is selected in the ignition switch 48. When the result is negative, the program is immediately terminated. On the other hand, when the result is affirmative, the program proceeds to S12 in which it is determined whether the detected engine speed NE is less than 100 rpm, i.e., it is determined whether the engine is stopped. When the result is negative, the program proceeds back to S10.

When the result in S12 is affirmative, the program proceeds to S14 in which the buzzer 140 is sounded to alert the operator. When the engine 16 is stopped, since idling is more likely to flow at the ON position, this is done to warn the operator as a precaution.

The program then proceeds to S16 in which it is determined whether a period of time during which the buzzer 140 continues to sound, exceeds a predetermined period of time (e.g., 180 sec.), i.e., it is determined whether the buzzer 140 sounds for the predetermined period of time. When the result is negative, the program proceeds back to S10 to repeat the procedures mentioned above.

On the other hand, when the result in S16 is affirmative, the program proceeds to S18 in which the buzzer 140 is stopped to sound and the ON signal supply to the transistor base terminal is discontinued to make the main relay 180 off, in other words, the battery voltage supply to the electric loads, the electric motor (for throttle) 40, the electric motor (for shift-changing) 42 and the power tilt-trim unit 44 is discontinued. As shown in FIG. 6, since the warning unit 184 is wired independently of the main relay 180, the warning unit 184 can still act after the main relay 180 was shut off.

The program then proceeds to S20 in which it is again determined whether the ON position is selected in the ignition switch 48. When the result is affirmative, the program proceeds back to S18 to keep the main relay 180 off. On the other hand, when the result is negative, the program proceeds to S22 in which the main relay 180 is made on and the off-state of the main relay 180 is terminated.

Thus, since idling current is more likely to flow at the ON position when the engine 16 is stopped, the buzzer 140 is sounded to warn the operator as a precaution and if it is found that the ON position is still selected even after the predetermined period of time has passed, the battery voltage supply to the electric loads, the motors 40, 42 and the unit 44 is discontinued. With this, it becomes possible to prevent, more effectively the battery 46 from becoming dead.

As mentioned above, the embodiment is thus arranged to have a system for starting an internal combustion engine 16 installed in an outboard motor 10 mounted on a boat 12 and having a propeller 24 powered by the engine and a mechanism (steering mechanism) driven by an electric actuator (for steering) 38, the engine having other electric loads including at least an electronic control unit (ECU) 20 to be used for operating the engine, including: a battery 46 connected to the engine; a starter motor 170 that starts the engine when voltage is supplied from the battery; and an ignition switch 48 provided in a voltage supply circuit from the battery to the starter motor, the electric actuator and the electric loads; the ignition switch having positions selected by an ignition key 152; wherein the positions of the ignition switch including at least a START position at which the starter motor, the electric actuator (electric motor 38) and the electric loads are supplied with the voltage from the battery; an ON position at which the voltage supply to the starter motor is discontinued when the key is turned from the START position, a first OFF position (OFF1) at which the voltage supply to the electric actuator and the electric loads is discontinued when the key is turned from the ON position, and a second OFF position (OFF2) at which the current supply to the electric actuator (electric motor 38) is still continued when the key is turned from the ON position. Alternatively, the positions of the ignition switch includes at least a first position (START) at which the starter motor is supplied with the voltage from the battery, a second position (ON) at which the electric actuator and the electric loads are supplied with the voltage from the battery, a third position (OFF1) at which the voltage supply to the electric actuator and the electric loads is discontinued, and a fourth position (OFF2) at which the current supply to the electric actuator is still continued.

In the system, the ignition key 152 can be pulled out (from a keyhole 150) only when the key is at the first OFF position, and manipulation of the key to select the second OFF position is made different from that to select the first OFF position.

The system further includes: a warning unit 184 that discontinues the current supply to the electric loads if the ON position is kept selected for a predetermined period of time when the engine is stopped (S10 to S22). The warning unit warns an operator (sounds a buzzer 140) if the ON position is kept selected when the engine is stopped.

In the system, the electric actuator for the mechanism is an electric motor 38 for a steering mechanism of the outboard motor 10.

It should be noted that, the embodiment is arranged such that only the motor (for steering) 38 is driven at the second OFF position (OFF2), the embodiment can be modified such that the other motors 40, 42 and the unit 44 are also driven at that position.

The entire disclosure of Japanese Patent Application No. 2002-289972 filed on Oct. 2, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A starting system of an internal combustion engine installed in an outboard motor mounted on a boat and having a propeller powered by the engine and a mechanism driven by an electric actuator, the engine having other electric loads including at least an electronic control unit to be used for operating the engine, comprising:

a battery connected to the engine;

a starter motor that starts the engine when voltage is supplied from the battery; and an ignition switch provided in a voltage supply circuit from the battery to the starter motor, the electric actuator and the electric loads, the ignition switch having positions selected by an ignition key;

wherein the positions of the ignition switch including at least a START position at which the starter motor, the electric actuator and the electric loads are supplied with the voltage from the battery; an ON position at which the voltage supply to the starter motor is discontinued when the key is turned from the START position, a first OFF position at which the voltage supply to the electric actuator and the electric loads is discontinued when the key is turned from the ON position, and a second OFF position at which the current supply to the electric actuator is still continued when the key is turned from the ON position.

2. A system according to claim 1, wherein the ignition key can be pulled out only when the key is at the first OFF position.

3. A system according to claim 1, wherein manipulation of the key to select the second OFF position is made different from that to select the first OFF position.

4. A system according to clam 1, further including:

a warning unit that discontinues the current supply to the electric loads if the ON position is kept selected for a predetermined period of time since stopping of the engine.

5. A system according to claim 4, wherein the warning unit warns an operator if the ON position is kept selected since stopping of the engine.

6. A system according to claim 1, wherein the electric actuator for the mechanism is an electric motor for a steering mechanism of the outboard motor.

7. A starting system of an internal combustion engine installed in an outboard motor mounted on a boat and having a propeller powered by the engine and a mechanism driven by an electric actuator, the engine having other electric loads including at least an electronic control unit to be used for operating the engine, comprising:

a battery connected to the engine;

a starter motor that starts the engine when voltage is supplied from the battery; and an ignition switch provided in a voltage supply circuit from the battery to the starter motor, the electric actuator and the electric loads, the ignition switch having positions selected by an ignition key;

wherein the positions of the ignition switch including at least a first position at which the starter motor is supplied with the voltage from the battery, a second position at which the electric actuator and the electric loads are supplied with the voltage from the battery, a third position at which the voltage supply to the electric actuator and the electric loads is discontinued, and a fourth position at which the current supply to the electric actuator is still continued.

8. A system according to claim 7, wherein the ignition key can be pulled out only when the key is at the third position.

9. A system according to claim 7, wherein manipulation of the key to select the fourth position is made different from that to select the third position.

10. A system according to clam 7, further including:

a warning unit that discontinues the current supply to the electric loads if the second position is kept selected for a predetermined period of time since stopping of the engine.

11. A system according to claim 10, wherein the warning unit warns an operator if the second position is kept selected since stopping of the engine.

12. A system according to claim 7, wherein the electric actuator for the mechanism is an electric motor for a steering mechanism of the outboard motor.

* * * * *